United States Patent [19]

Jensen

[11] 4,142,961

[45] Mar. 6, 1979

[54] HYDROPROCESSED SHALE OIL INCLUDING THERMALLY TREATING AND COKING STEPS

[75] Inventor: Harbo P. Jensen, San Rafael, Calif.

[73] Assignee: Chevron Research Company, San Francisco, Calif.

[21] Appl. No.: 865,637

[22] Filed: Dec. 29, 1977

[51] Int. Cl.[2] ..... C10G 25/00; C10G 23/00

[52] U.S. Cl. ..... 208/91; 208/50; 208/97

[58] Field of Search ..... 208/88, 89, 50, 85, 208/91, 97, 99

[56] References Cited

U.S. PATENT DOCUMENTS

| | | | |
|---|---|---|---|
| 2,988,501 | 6/1961 | Inwood | 208/216 |
| 3,542,669 | 11/1970 | DeFeo | 208/91 |
| 3,617,481 | 11/1971 | Voorhies, Jr. et al. | 208/50 |
| 3,738,931 | 6/1973 | Frankovich et al. | 208/89 |
| 3,773,653 | 11/1973 | Nongbri et al. | 208/89 |

FOREIGN PATENT DOCUMENTS

| | | | |
|---|---|---|---|
| 935189 | 10/1973 | Canada | 208/91 |

*Primary Examiner*—George Crasanakis

*Attorney, Agent, or Firm*—D. A. Newell; R. H. Davies; M. K. Bosworth

[57] ABSTRACT

An arsenic-contaminated shale oil is thermally treated to precipitate the arsenic and to lower the pour point. Treated oil is then transported and thereafter heated to produce coke and a liquid hydrocarbon distillate. At least a portion of the distillate is catalytically processed in the presence of hydrogen, forming a treated shale oil product.

10 Claims, No Drawings

HYDROPROCESSED SHALE OIL INCLUDING THERMALLY TREATING AND COKING STEPS

BACKGROUND OF THE INVENTION

1. Field of the Invention

This invention relates to the treating and transporting of shale oil. More particularly, shale oil is thermally treated to reduce the arsenic content and to reduce the pour point, and the thus-treated oil is transported by pipeline and subsequently heated to produce coke and a liquid hydrocarbon distillate. Surprisingly, the liquid hydrocarbon distillate is hydroprocessed more easily than treated oil which has not been coked.

2. Statement of the Problem

The shale oil produced by conventional retorting processes has a number of characteristics which cause difficulties in transportation and/or catalytic hydroprocessing of the oil. Of these characteristics, one of the most bothersome is the high pour point of the retorted shale oil. "Pour point" is the temperature at which congelation or stoppage of flow is observed for a particular oil, and a high-pour-point oil is often difficult to handle at ambient temperature. There is no fixed relationship between the pour point and the viscosity of a given oil.

In the United States, most oil shale deposits are located in areas where the temperature during a good portion of the year is below 40° F. (4.4° C.), and often below freezing (32° F., 0° C.), while typical pour points of shale oils from existing retorting processes are in the range of 65° to 85° F. (18° to 29° C.) or more. Movement of the oil at temperatures only slightly above the pour point of an oil by ordinary fluid handling operations is difficult and commercially impractical; and at temperatures at or below the pour point, ordinary fluid handling of the oil is even more difficult. Therefore, transportation of shale oils, especially over relatively long distances by pipeline, is generally impractical unless expensive pour point depressants, expensive processing or heated pipelines are preliminarily employed.

Another detrimental characteristic of shale oil is that it frequently contains contaminants which tend to interfere with subsequent refining and catalytic processing operations such as hydrogenation. In some instances, these contaminants (soluble arsenic and iron in particular) may poison or inactivate catalysts used in such operations. Even if shale oil is employed directly as a fuel, the removal of such contaminants may be desirable from an environmental protection standpoint. Thus, it is desirable that arsenic, iron and other contaminants be removed or reduced to low concentrations in the shale oil before it is further processed or used as a fuel.

3. Description of the Prior Art

U.S. Pat. No. 3,284,336 and U.K. Pat. No. 995,106 disclose a process for reducing the pour point of shale oils by separating shale oil into light and heavy fractions, thermally treating the heavy fraction, and recombining both fractions. U.S. Pat. No. 3,738,931 discloses hydrovisbreaking shale oil, followed by hydrogenation of the vaporized visbroken oil and recombining the vapors with unvaporized oil to give a shale oil having a reduced pour point. U.S. Pat. No. 3,523,071 describes visbreaking and fractionation of a shale oil, with the higher boiling fraction of the visbroken shale oil combined with a portion of unvisbroken shale oil to give a low pour point product. U.S. Pat. No. 3,532,618 describes hydrovisbreaking shale oil to give a low pour point product. These references do not discuss contaminant removal by thermal treatment, or the effects of thermal treatment on the hydroprocessability of the oil.

Heretofore, arsenic has been removed from hydrocarbon charge stocks by contacting the charge stock with oxides of iron, cobalt or nickel and substantial amounts of water at a low temperature, as disclosed in U.S. Pat. No. 2,778,799. The oxide acts as an oxidizing agent which oxidizes the arsenic to a water-soluble arsenic oxide. The arsenic oxide is dissolved by the water and removed from the hydrocarbon. Also, arsenic has been removed from raw shale oil by contacting the shale oil in the absence of water with a catalyst, such as oxide or sulfide compounds of iron, cobalt or nickel at an elevated temperature under hydrogen pressure, see for instance U.S. Pat. Nos. 3,876,533; 3,933,624; 3,954,603; 4,003,829 and 4,051,022.

U.S. Pat. No. 4,029,571 discloses a method for thermally treating shale oil, either in the presence or the absence of hydrogen, to form an arsenic-containing precipitate suspended in the oil which must be subsequently separated. Although the method of this reference produces a treated oil having a reduced pour point and reduced levels of arsenic and selenium contaminants, the required step of precipitate removal (such as by centrifuging or filtering) is cumbersome, time-consuming and prone to mechanical difficulties.

In other uses, a thermal treating step has been employed to remove various metallic contaminants from petroleum hydrocarbons, as has been described in U.S. Pat. No. 2,910,434. This reference discloses removal of up to 26 various trace metals, but not arsenic, from a petroleum crude oil feed by non-catalytically reacting the feed with hydrogen in the presence of an inert packing material to form a treated oil of reduced metal content and a solid metal-containing residue. Although the packing may retain a portion of the residue, this reference requires that the treated oil and the remaining residue must be separated by means such as filtration and settling, which are time-consuming and prone to equipment failures. U.S. Pat. No. 3,947,347 discloses removal of the same metals from a hydrocarbon feed by contacting the feed with hydrogen and an inert packing material having a specified pore diameter range to deposit the contaminants on the inert material. U.S. Pat. No. B438,916 discloses demetallation (nickel, vanadium, iron, copper, zinc or sodium but not arsenic) of a residual petroleum fraction by contacting the oil with a refractory oxide in the absence of added hydrogen. These references do not concern arsenic removal or pour point reduction, nor do they recognize that the thermally treated oil is relatively difficult to hydroprocess when compared with the untreated shale oil. Further, they do not suggest a way to improve the hydrogen processability of the oil once it has been thermally treated.

OBJECTS OF THE INVENTION

It is an object of the present invention to provide a method of treating shale oil so that it may be processed at a location remote from the retort. Another object is to provide a method of treating shale oil to render it suitable for transporting and subsequent catalytic hydroprocessing. A further object of the present invention is to provide a method of treating shale oil to provide coke and a shale oil product having a reduced level of contaminants such as arsenic.

SUMMARY OF THE INVENTION

In accordance with one embodiment of this invention there is provided a method wherein an arsenic-contaminated shale oil is thermally treated to precipitate the arsenic and to reduce the pour point. The oil is subsequently transported and thereafter coked, producing coke and a liquid hydrocarbon distillate. At least a portion of the distillate is then catalytically hydroprocessed to yield a shale oil product.

In accordance with a preferred embodiment of the present invention there is provided a method for producing a hydroprocessed shale oil product from a shale oil feedstock contaminated with more than 8 ppm arsenic in the form of at least one soluble arsenic compound and having an initial pour point in excess of 40° F. (4.4° C.), which comprises:

(a) forming an arsenic-containing precipitate and an aged shale oil having a pour point at least 10° F. (5.6° C.) lower than the initial pour point by thermally treating said feedstock at a temperature of 600° to 800° F. (316° to 427° C.) for 1 to 300 minutes at a pressure sufficient to maintain the oil substantially in the liquid phase;

(b) transporting said aged shale oil;

(c) producing coke and a normally liquid hydrocarbon distillate by coking at least a portion of said aged shale oil; and (d) producing a hydroprocessed shale oil product containing not more than 4 ppm arsenic by catalytically processing at least a portion of said distillate at an elevated temperature and in the presence of hydrogen and a catalyst.

Further, in accordance with the present invention, at least a portion of the precipitate may be removed from the aged shale oil before transporting the aged shale oil. The precipitate may either be deposited upon a solid contact material which may be present during the thermal treating, or may be mechanically separated from the aged shale oil.

Still further in accordance with the present invention, at least a portion of the precipitate may be transported along with the aged shale oil, and the coke will then contain at least a portion of the precipitate.

DETAILED DESCRIPTION OF THE INVENTION

1. The Feedstock

The feedstock for this invention is a shale oil produced by any conventional retorting process. Conventional retorting processes are carried out by destructive distillation of naturally-occurring oil shale at temperatures which usually range from 900° to 1300° F. (482° to 704° C.). The retorting may be carried out in a retort either in situ or above ground, with the necessary heat being supplied to the shale oil by direct combustion within the retort or by indirect heating means such as contact with hot gases or solids.

Shale oil has a number of characteristics such as a high pour point which makes it difficult to transport, and a high contaminant level which makes it difficult to subsequently refine or process. Typical pour points of shale oils produced by conventional retorting processes range upward from 40° F. (4.4° C.), and in particular, are usually within the range of 65° to 85° F. (18° to 29° C.). Contaminants occuring in shale oil produced by conventional retorting processes include arsenic and frequently iron. The level of arsenic contamination in retorted shale oil is generally more than 8 parts per million by weight and frequently from 20 to 100 or more parts per million arsenic by weight. The level of iron contaminant is generally at least 10 ppm by weight, and may range from 30 to 500 ppm. The levels of arsenic and iron contaminant in a given shale oil will, of course, depend upon the origin of the oil and upon the particular retorting process and conditions used to remove it from the shale.

2. The Thermal Treating Step

The first step of the present method is to form an arsenic-containing precipitate and an aged shale oil by thermally treating the shale oil feedstock. In the thermal treating step, the oil is maintained within a specified temperature range for a length of time sufficient to form the precipitate and lower the pour point. The range of temperature which may be employed to effect the requisite decrease in pour point in a particular shale oil will depend upon the composition of the particular oil and may be predetermined by appropriate runs using the oil. However, the thermal treating step will be carried out at temperatures within the range of 600° to 800° F. (316° to 427° C.), and preferably from 700° to 750° F. (371° to 399° C.).

The thermal treating will be carried out for a time sufficient to effect both precipitation of at least a portion of the soluble arsenic content of the oil and reduction in the pour point of at least 10° F. (5.6° C.). The length of the thermal treatment will generally range from 1 to 300 minutes, and preferably from 1 to 120 minutes and still more preferably from 5 to 60 minutes. The pressure at which the thermal treatment occurs should be sufficient to maintain the oil substantially in the liquid phase, and is generally from 0 to 5000 psig, and preferably from 0 to 1500 psig.

The thermal treating step can be carried out either in the presence or absence of hydrogen. Treatment in the absence of added hydrogen is a preferred embodiment of this invention for two reasons: locating a hydrogen plant at the retort site is usually economically impractical and low pressure vessels are cheaper than higher pressure vessels. However, when the thermal treatment is carried out in the presence of added hydrogen, the hydrogen partial pressure will preferably range from 500 to 1500 psig.

The thermal treating step can be carried out either in the presence or absence of a solid contact material. When the thermal treating is carried out in the presence of the solid contact material, the contact material can have any shape and can be in the form of pellets, spheres, or shaped particles. The contact material will be of any of the sizes suitable for a solid contact material. Specifically, the particles will not be so small as to pack into a flow blocking mass and they preferably will range in size from 1/32" to 3" in diameter or length. The contact material may be non-porous, but preferably it will be porous, have a surface area of at least 0.5 square meter per gram, and also have a major portion of pore radii greater than about 20 Angstroms. The contact material comprises any suitable solid which maintains its structural integrity under conditions of the thermal treating step, for example activated carbon, silica, alumina, or other inorganic oxides, spent catalysts, naturally occurring clays such as fuller's earth, kieselguhr, pumice, bauxite, or combinations of two or more thereof. It is preferred for the contact material to be inert. An especially preferred contact material is bauxite.

When the oil is thermally treated in the presence of the contact material, at least a portion of the arsenic-containing contaminant desposits upon the contact material. After an amount of precipitate has deposited, fresh contact material can be exchanged for the contact material upon which the precipitate has deposited. Alternatively, the contact material upon which the precipitate has deposited may be treated by any conventional means to remove the precipitate, for example by oxidation and vaporization. When the term "precipitate" is used herein, it refers to any solid or semi-solid material that is insoluble in and separates from or is capable of being physically separated from the liquid portion of the thermally treated shale oil.

When the thermal treating step is carried out in the absence of added hydrogen and in the presence of a contact material, the aged oil will contain less arsenic than the feedstock, and usually will contain from 8 to 15 ppm by weight arsenic. The range will, of course, vary depending upon the source and previous treatment of the shale oil feed.

Alternatively, the thermal treating step can be carried out in the absence of a solid contact material, and the precipitate will then form within the oil as minute, suspended particles. The precipitate need not be separated from the oil at this stage because the presence of the precipitate generally does not interfere with transporting the oil. When the precipitate-containing oil is coked, the precipitate will remain in the coke.

The above-mentioned precipitate contains a significant amount of the soluble arsenic contaminant that was present in the shale oil feed, thus providing an effective method for removal of arsenic. In addition to arsenic, the precipitate can also contain significant amounts of other contaminants including iron, selenium, calcium, cobalt, molybdenum, strontium, zinc, nickel, lead, copper, potassium, etc. When the shale oil feedstock contains significant amounts of iron, such as 10 ppm, or frequently 30 ppm by weight or more, in the form of at least one soluble compound, the precipitate may contain iron or iron compounds such as iron arsenide. The distillate will then contain less than all the iron in the feedstock.

The lowering of the pour point effected during the thermal treating step does not appear to be affected by the presence or absence of hydrogen or the presence or absence of a solid contact material. Apparently, thermal treatment of the shale oil feedstock produces a pour point depressant which alters the morphology of wax crystals which form in the oil, to give an aged shale oil having a pour point at least 10° F. (5.6° C.) lower than the initial pour point of the untreated shale oil. To achieve maximum benefit from the method of this invention, the shale oil is thermally treated near the retort before any lengthy transporting has occurred, thus avoiding the difficulties of transporting the oil before the pour point is lowered by the thermal treating step. If desired, the aged shale oil may be admixed with untreated shale oil prior to transporting the aged shale oil.

The thermal treating step of this invention is to be distinguished from visbreaking techniques practiced by the prior art. Visbreaking is a pyrolysis treatment of an oil to destroy waxes and high-molecular-weight constituents therein, thus reducing the viscosity of the oil. In visbreaking, considerable cracking is desired and is obtained along with formation of a substantial amount of coke. In the thermal treating step of this invention, however, little if any cracking or coke formation occurs. The distinction between visbreaking and thermal treating is illustrated by the fact that distillation curves of visbroken oils are materially different from those of the original feedstock, whereas distillation curves of oils thermally treated in accordance with the present invention do not differ appreciably from those of the original feedstock.

3. Transporting by Pipeline

The step of transporting the aged oil includes transporting by truck, railroad tankcar or, preferably, pipeline. Each of these methods is within the skill of a person familiar with the art of transporting oils, and therefore need not be discussed herein. A lowered pour point will facilitate handling, pumping, loading and unloading of the shale oil and prevent solidification without the necessity of heating the oil.

4. Coking

After the aged shale oil has been transported by pipeline, at least a portion of it is then subjected to a coking operation. Coking is a well known thermal cracking process for the conversion of an oil into a distillate and coke. Any suitable coking method, for example delayed coking or fluid coking, may be used in the method of the present invention. Coking typically involves heating the oil to temperatures from 750° to 2000° F. (399° to 1093° C.) at a pressure of atmospheric or above, preferably from atmospheric to 70 psig.

One effect of the coking step is to remove any arsenic-containing precipitate remaining in the aged shale oil. The arsenic-containing precipitate will remain in the coke as will any shale fines which were present in the aged shale oil and the distillate will contain less arsenic than the aged shale oil. Where the precipitate contains iron or other contaminants in addition to arsenic, the precipitate will still remain in the coke. Because the precipitate and shale fines are removed in the coking step, there is no need to filter the shale oil as was taught in the art.

The thermal treating step has the advantage of lowering the pour point and reducing the soluble arsenic content of shale oil. Thermally treated shale oil, however, is more difficult to hydroprocess than shale oil which has not been so treated. After coking, the susceptibility of both treated and untreated oils to hydroprocessing is improved. Both oils give approximately the same yield of coker distillate, and both coker distillates hydroprocess equally well. Thus, coking nullifies the undesirable effects of the thermal treatment. The effect of coking on thermally treated shale oil is surprising because the art does not recognize that the thermal treatment step decreases the susceptibility of shale oil to subsequent catalytic hydroprocessing, such as hydrodesulfurization and hydrodenitrification. "Susceptibility to catalytic hydroprocessing" means the ease with which a catalyst can, in the presence of hydrogen, change or modify the chemical composition of an oil.

If desired, immediately prior to the coking step, the aged shale oil is fractionated into a light distillate fraction which contains substantially no precipitate and a heavy fraction which is the portion that is coked in the coking step. The light distillate may then be combined with the portion of the coker distillate to be catalytically hydroprocessed.

5. Catalytic Hydroprocessing

Catalytic hydroprocessing includes such well-known reactions as hydrodesulfurization, hydrodenitrification, hydrodearsenation, hydrodemetallation, hydrogenation of olefins and aromatics and hydrocracking, which reactions may occur separately or concurrently. Catalytic hydroprocessing is carried out in a conventional manner at conditions including a temperature of 400° to 1000° F. (204° to 588° C.), preferably 600°–900° F. (316°–482° C.), a pressure of 50 to 3000 psig, preferably 300–1500 psig, and a liquid hourly space velocity (volumes of oil per hour per volume of catalyst) from 0.1 to 30 and preferably from 0.5 to 10. Hydroprocessing catalysts are well known to the art and include catalysts containing a combination of Group VI metal or metals (e.g., chromium, molybdenum and tungsten) with Group VIII metal or metals (e.g., iron, nickel and cobalt), with or without additional metals such as those in Group IV, and a carrier material. An example of a suitable catalyst is cobalt-molybdate on a silica-alumina support.

At least a portion of the coker distillate will be catalytically hydroprocessed. After being catalytically hydroprocessed, the portion will contain less than 4 ppm by weight arsenic, and preferably less than 1 ppm by weight arsenic.

EXAMPLES

In order to more fully illustrate the method of the present invention, the following specific examples which in no sense limit the invention are presented.

EXAMPLE I

A Colorado shale oil having an initial pour point of +65° F. was thermally treated in a continuous bench-scale process at 750° F. (399° C.) and atmospheric pressure for at an LHSV of 1 (a liquid hourly space velocity of one volume of liquid per hour per volume of contact material) in the presence of granular activated carbon particles about 1 mm in size. The resulting aged shale oil had a pour point of −50° F. (−46° C.) and because of the lower pour point is more suitable than untreated oil for transporting by pipeline at ambient temperatures.

EXAMPLE II

A Colorado shale oil derived by the direct combustion mode and containing 34 ppm arsenic was thermally treated at 650° F. (343° C.) and atmospheric pressure for 1 hour in the presence of granular activated carbon particles about 1 mm in size. The resulting aged shale oil had an arsenic content of 14 ppm, a reduction of about 59%. The same feedstock was run under similar conditions except for a temperature of 750° F. (399° C.), and yielded an aged oil having 11 ppm arsenic, a reduction of about 68%.

EXAMPLE III

A Colorado shale oil containing 21 ppm arsenic was heated at 750° F. (399° C.) under 1000 psig $H_2$ pressure for 1 hour in the absence of contact material. The resulting aged shale oil had an arsenic content of 3 ppm, a reduction of about 86%. The experiment was repeated using $N_2$, and the resulting aged shale oil had an arsenic content of 11 ppm, or reduction of 48%.

EXAMPLE IV

A Colorado shale oil containing 60 ppm iron and 21 ppm arsenic was thermally treated at 750° F. (399° C.) at atmospheric pressure for one hour in the presence of granular activated carbon particles about 1 mm in size. The resulting shale oil had an iron content of 22 ppm, a reduction of 63%, and an arsenic content of 11 ppm, a reduction of 48%.

EXAMPLE V

Aged shale oil containing 8 ppm As was coked at temperatures up to 1000° F. (538° C.) for 5 hours. Coker distillate containing 4.7 ppm As was recovered in an 88% yield. The coke contained the remaining arsenic.

EXAMPLE VI

Untreated (raw) shale oil, aged shale oil and the coker distillate from each were individually hydroprocessed over a nickel-molybdenum-containing hydroprocessing catalyst. Before hydroprocessing, the untreated shale oil contained 2.14 weight percent nitrogen, 0.57 weight percent sulfur and 16 ppm As. After hydroprocessing at a temperature of 780° F. (416° C.), 2000 psig hydrogen pressure, and a liquid hourly space velocity of 1, the contaminant levels were reduced to 0.4% nitrogen, 150 ppm sulfur and 0.01 ppm As.

The aged shale oil contained 2.18 weight percent nitrogen, 0.58 weight percent sulfur and 8 ppm arsenic, and after hydroprocessing under similar reaction conditions, the oil contained 0.7 weight percent nitrogen, 350 ppm by weight sulfur and 0.02 ppm by weight arsenic. These data show that aged shale oil is more difficult to hydroprocess than raw shale oil.

Raw shale oil coker distillate containing 1.95 weight percent nitrogen, 0.51 weight percent sulfur, and 6.6 ppm by weight arsenic was hydroprocessed under similar reaction conditions. The resulting oil contained 0.07 weight percent nitrogen, 122 ppm by weight sulfur and <0.005 ppm by weight arsenic.

Aged shale oil coker distillate containing 1.84 weight percent nitrogen, 0.50 weight percent sulfur and 5 ppm by weight arsenic was also hydroprocessed under similar reaction conditions. The resulting oil contained only 0.07 weight percent nitrogen, 120 ppm by weight sulfur and <0.005 ppm by weight arsenic. These data show that coker distillate from aged shale oil is hydroprocessed equally as well as coker distillate from raw shale oil, and more easily than uncoked aged shale oil or raw shale oil.

Over-all, these data show that the present method is an effective way of thermally treating shale oil to form an arsenic-containing precipitate and an aged shale oil having a reduced pour point which makes the oil especially suitable for transporting by pipeline. Coking the aged oil produces coke and a coker distillate having a reduced arsenic content. The coker distillate is more easily hydroprocessed than the aged shale oil — after catalytic hydroprocessing, coker distillate contained only 10% of the nitrogen, 34% of the sulfur and substantially less arsenic compared to the uncoked aged shale oil. The reduced contaminant levels of the hydroprocessed coker distillate make it especially suitable for further processing over catalysts sensitive to such contaminants.

What is claimed is:

1. A method for producing a hydroprocessed shale oil product from a shale oil feedstock contaminated with more than 8 ppm arsenic in the form of at least one soluble arsenic compound and having an initial pour point in excess of 40° F. (4.4° C.), which method comprises:

(a) forming an arsenic-containing precipitate in an aged shale oil having a pour point at least 10° F. (5.6° C.) lower than said initial pour point by thermally treating said feedstock at a temperature of 600° to 800° F. (316° to 427° C.) for 1 to 300 minutes at a pressure sufficient to maintain said oil substantially in a liquid phase;

(b) transporting said aged shale oil of reduced pour point by means of truck, railroad tank car or pipeline;

(c) producing coke and a normally liquid hydrocarbon distillate by coking at least a portion of said aged and transported shale oil; and (d) producing said shale oil product containing not more than 4 ppm arsenic and a lower contaminant content selected from the group consisting of sulfur, nitrogen and iron by catalytically reacting at least a portion of said distillate from step (c) at an elevated temperature in the presence of hydrogen and a catalyst.

2. A method as in claim 1 which includes the step of mechanically removing a portion of said precipitate from said aged oil from step (a) before transporting said aged oil.

3. The method as in claim 1 wherein said thermal treating is conducted in the presence of a solid contact material and wherein at least a portion of said precipitate is deposited upon said material.

4. A method as in claim 1, wherein at least a portion of said precipitate is transported in said pipeline along with said aged oil, and wherein said coke contains at least a portion of said precipitate.

5. A method as claimed in claim 1 wherein said thermal treating is carried out in the absence of added hydrogen.

6. The method as in claim 1 wherein said thermal treating is carried out in the presence of hydrogen at a hydrogen partial pressure from 50 to 5000 psig.

7. The method of claim 1 wherein said shale oil feedstock also contains at least 10 ppm iron in the form of at least one soluble iron compound, and said precipitate includes iron, and said distillate contains less of the iron present in said feedstock.

8. The method of claim 1 wherein immediately prior to step (c), said aged shale oil is fractionated into a light distillate fraction which contains substantially no precipitate and a heavy fraction which is said portion of shale oil that is coked in step (c).

9. The method of claim 1 wherein said aged shale oil is admixed with untreated shale oil prior to step (b).

10. The method of claim 1 wherein step (d) is conducted at a temperature of 400° to 1000° F. (204° to 558° C.), a pressure of 50 to 3000 psig and a liquid hourly space velocity from 0.1 to 30.

* * * * *